US006608451B2

(12) United States Patent
Collins

(10) Patent No.: US 6,608,451 B2
(45) Date of Patent: Aug. 19, 2003

(54) BALLAST CIRCUIT WITH AN IGNITOR FOR STARTING MULTIPLE HID LAMPS

(75) Inventor: Byron R. Collins, Tuxedo, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/682,873

(22) Filed: Oct. 26, 2001

(65) Prior Publication Data

US 2003/0080694 A1 May 1, 2003

(51) Int. Cl.[7] ..... H05B 41/16

(52) U.S. Cl. ..... 315/276; 315/209 CD; 315/277; 315/291; 315/DIG. 2; 315/DIG. 5

(58) Field of Search ..... 315/267, 276, 315/277, 291, 307, DIG. 2, DIG. 5, DIG. 7, 209 CD, 289, 290, 297

(56) References Cited

U.S. PATENT DOCUMENTS 4,695,771 A * 9/1987 Hallay ..... 315/290
4,916,364 A 4/1990 Collins ..... 315/290
4,959,593 A * 9/1990 Joanino ..... 315/290
5,017,840 A * 5/1991 Droho ..... 315/291
5,028,845 A 7/1991 Ravi et al. ..... 315/189
5,430,354 A * 7/1995 Garbowicz et al. ..... 315/88
5,608,296 A * 3/1997 Brown ..... 315/289
5,986,412 A 11/1999 Collins ..... 315/291
6,316,885 B1 * 11/2001 Collins et al. ..... 315/291

* cited by examiner

*Primary Examiner*—Don Wong
*Assistant Examiner*—Thuy Vinh Tran
(74) *Attorney, Agent, or Firm*—Fay, Sharpe, Fagan, Minnich & McKee, LLP

(57) ABSTRACT

A ballast circuit with an ignitor circuit for starting serially connected HID lamps is provided. The ballast circuit comprises an electromagnetic ballast arrangement for driving the lamps and an ignitor circuit for starting the lamps. In an embodiment of the invention, the ignitor circuit comprises a voltage-breakover device, a first capacitor, a resistor, a pulse autotransformer, and a second capacitor. A pulse autotransformer is associated with each subsequent lamp after a first lamp of the serially connected lamps.

8 Claims, 8 Drawing Sheets

BALLAST CIRCUIT WITH AN IGNITOR FOR STARTING MULTIPLE HID LAMPS

BACKGROUND OF INVENTION

The present invention relates to ballast circuits for powering high intensity discharge (HID) lamps, and more particularly to a ballast circuit with an ignitor circuit for starting plural HID lamps connected in series.

An HID lamp, such as a metal halide, ceramic metal halide (CMH), high pressure sodium, or mercury lamp, is typically powered by an electromagnetic ballast circuit incorporating an iron core. The ballast transformer receives voltage from a power source, and outputs a ballast voltage for driving the lamp. The ballast circuit, which uses the iron core to achieve the necessary voltage adjustment, represents a major component of ballast cost, as well as bulk. The foregoing type of ballast circuit typically suffers the problem of powering only a single HID lamp.

U.S. Pat. No. 5,986,412 to Collins provides a ballast circuit for a plurality of serially connected, high-pressure gas discharge lamps. The ballast circuit comprises an electromagnetic ballast arrangement receptive of an input power signal, providing an output ballast voltage for driving the plurality of lamps, and providing an open circuit ballast voltage when the lamps are disconnected from the arrangement. A first ignitor circuit is connected between the ballast arrangement and the first lamp, and produces at least one ignitor pulse of high voltage and high frequency compared to the open circuit ballast voltage, to initiate starting of the first lamp. A second ignitor circuit is connected between the first lamp and a second lamp so as to be supplied with current through the first lamp. The second circuit produces at least one ignitor pulse of high voltage and high frequency compared to the open circuit ballast voltage after the first lamp begins to start and drops substantially in impedance, to initiate starting of the second lamp.

It is desirable to start a plurality (e.g. dual) of HID lamps with an ignitor circuit. If the ignitor circuit can start a plurality of HID lamps, it can eliminate redundant parts and reduces per-lamp ballast/ignitor cost.

SUMMARY OF INVENTION

The invention overcomes the foregoing problem in several exemplary embodiments that comprise a ballast/ignitor circuit capable of starting a plurality of HID lamps. In one aspect of the invention, a ballast/ignitor circuit is provided for serially connected HID lamps. In an embodiment of the invention, the ballast circuit comprises an electromagnetic ballast arrangement receptive of an input power signal, providing an output ballast voltage for driving the lamps; and an ignitor circuit connected to the ballast arrangement and to each lamp for starting all of the lamps and for producing at least one ignitor pulse to start each lamp.

In another embodiment of the invention, the ballast circuit comprises an electromagnetic ballast arrangement receptive of an input power signal, providing an output ballast voltage for driving the plurality of lamps, and providing an open circuit ballast voltage when the lamps are disconnected from the arrangement; and an ignitor circuit connected to the ballast arrangement and to each lamp for starting all of the lamps and for producing at least one ignitor pulse of high voltage and high frequency compared to the open circuit ballast voltage to start each lamp.

In another aspect of the invention, the ignitor circuit provides for starting each of serially connected, high intensity discharge lamps. In an embodiment of the invention, the ignitor circuit comprises a voltage-breakover device; a first capacitor with a first lead coupled to a first lead of the voltage-breakover device; a resistor with a first lead coupled to the first lead of the voltage-breakover device and first lead of the first capacitor; a pulse autotransformer associated with each subsequent serially connected, high intensity discharge lamp after a first lamp of serially connected lamps, each autotransformer having a winding connected between two serially connected lamps and a tap; and a second capacitor with first and second leads, wherein the first lead is coupled to a second lead of the resistor and the second lead is coupled to the tap of the pulse autotransformer.

In another embodiment of the invention, the ignitor circuit comprises a voltage-breakover device; a first capacitor; a resistor with a first lead coupled to a first lead of the first capacitor; a pulse transformer associated with each subsequent serially connected, high intensity discharge lamp after a first lamp of the plurality of serially connected lamps, each pulse transformer having a primary winding and a secondary winding, wherein the secondary winding is connected between two serially connected lamps and the primary winding is connected between the voltage-breakover device and the coupled first capacitor and resistor; and a second capacitor with a first lead coupled to a second lead of the resistor and a second lead coupled to a first lead of the secondary winding, said first lead of the secondary winding also being coupled to a preceding serially connected lamp.

DETAILED DESCRIPTION

Figure 1:
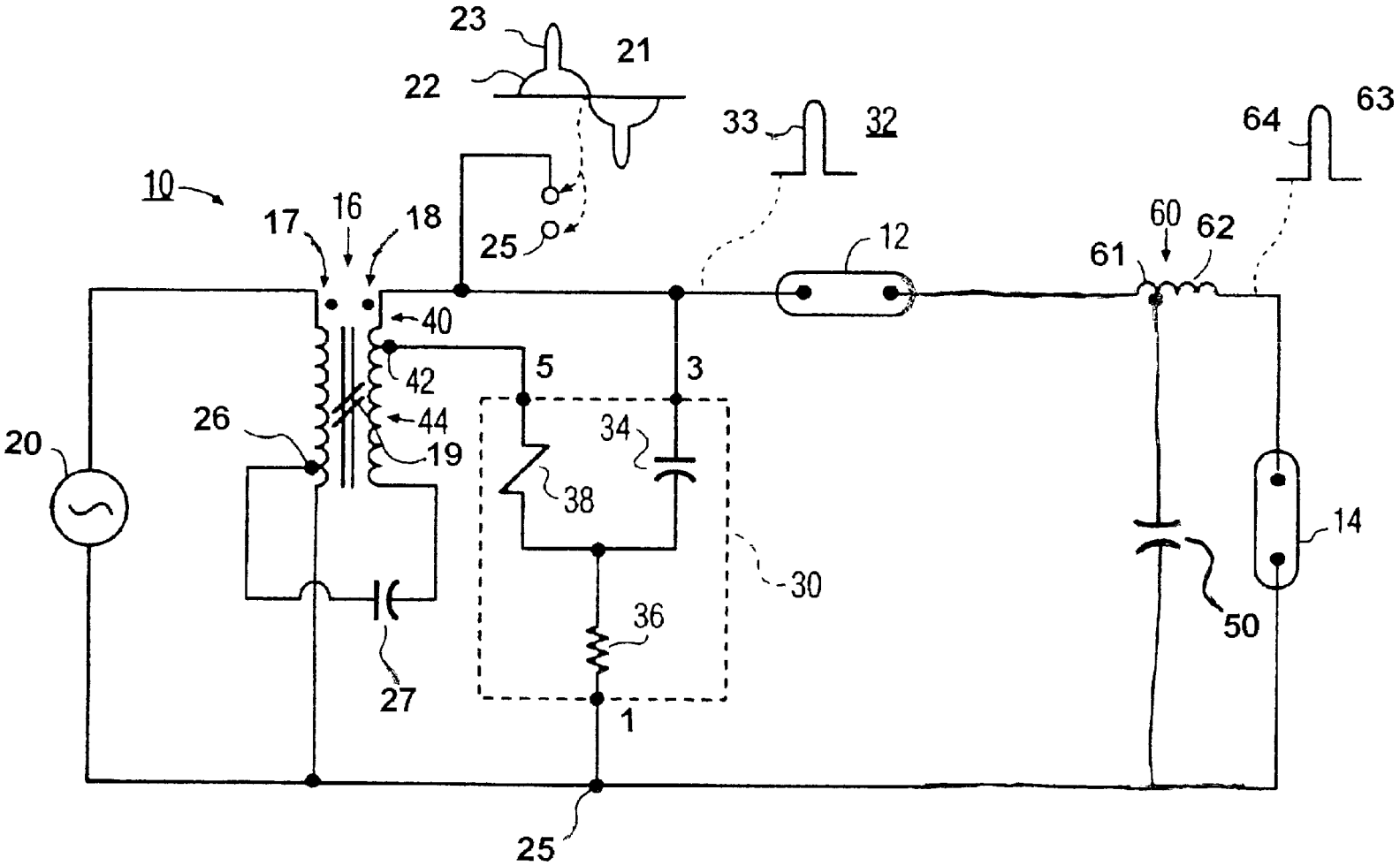
FIG. 1 is a schematic diagram of a ballast/ignitor circuit for powering a plurality of HID lamps in accordance with an embodiment of the invention.

FIG. 1 shows a ballast/ignitor circuit 10 for powering two HID lamps 12, 14. As shown, the HID lamps 12, 14 are connected in series. The ballast/ignitor circuit 10 is a constant-wattage autotransformer (CWA) circuit. A primary winding 17 of an electromagnetic (e-m) component 16 receives an AC power signal from a source 20, and produces, as an output, a, ballast voltage 21 on secondary winding 18 with respect to a reference node 25, for driving the HID lamps 12, 14. The e-m component 16 is part of a regulating ballast; its secondary winding 18 is tapped into primary winding 17 at 26, and its primary and secondary windings 17, 18 are shunted as indicated by diagonal lines 19. A ballast capacitor 27 produces a desired phase angle between current and voltage supplied by source 20, and, in combination with e-m component 16, limits current to the HID lamps 12, 14.

The specific type of e-m component used, however, is not critical to the invention and other e-m components providing a suitable ballast voltage for driving the HID lamps 12, 14 may be used, such as a reactor or lag ballast.

For starting HID lamp 12, ballast/ignitor circuit 10 includes an ignitor pulse circuit 30 for producing one or more ignitor pulses 32. Of particular interest is the high frequency content of the rapidly rising, leading edge 33 of pulse 32 with respect to ballast voltage 21. Such high frequency content is referred to herein as a high frequency and high voltage ignitor pulse 32, although such pulse may comprise only the higher frequency part of the overall ignitor pulse 32.

Figure 2:
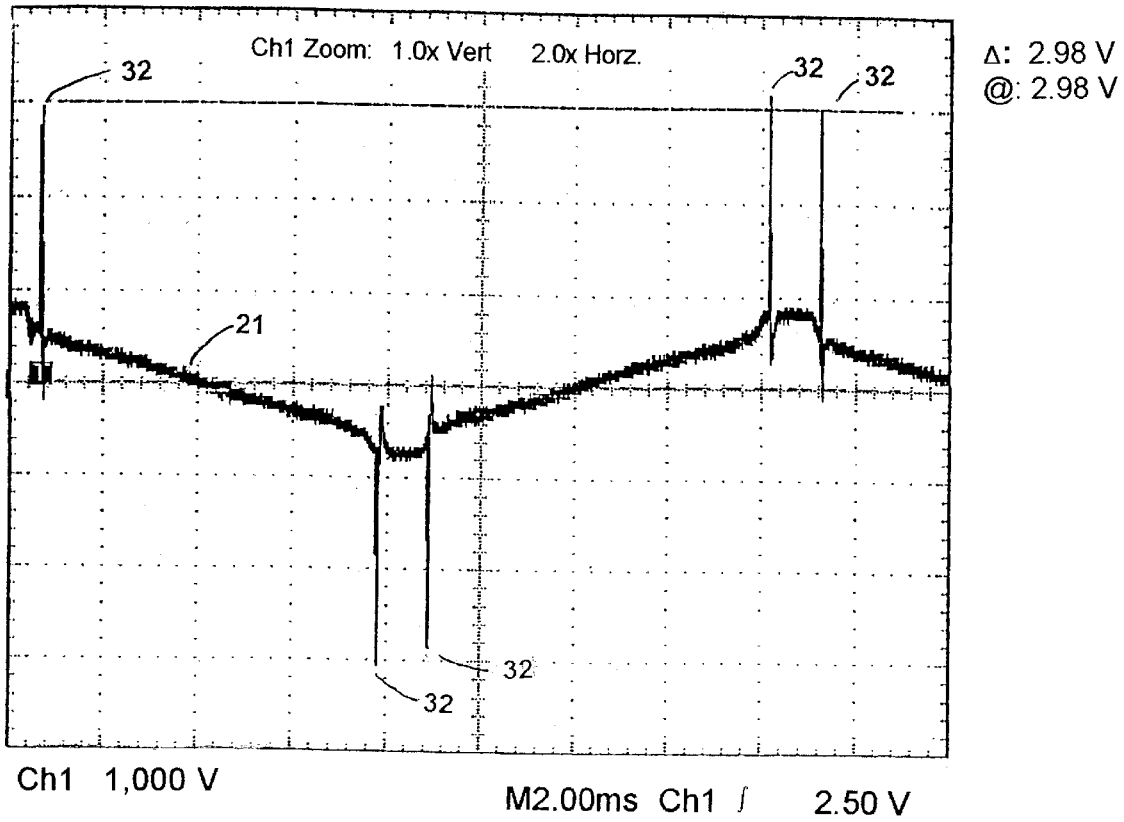
FIG. 2 shows the open circuit voltage of the ballast/ignitor circuit of FIG. 1 with respect to a first serially connected HID lamp.

Although ignitor pulse 32 is shown as positive, on the next negative excursion of ballast voltage 21, ignitor pulse 32 would be negative, as shown in FIG. 2. The particular form of ignitor pulse circuit 30 shown is merely exemplary, and other configurations will be apparent to those of ordinary skill in the art based on this specification.

The ignitor pulse circuit 30 includes a capacitor 34, which becomes charged from ballast voltage 21 via a resistor 36. The voltage across capacitor 34 is impressed across the series combination of a voltage-breakover (VBO) device 38 and a number of winding turns 40, via tap 42. During HID lamp 12, 14 starting, the voltage on capacitor 34 continues to rise until the similarly increasing voltage across VBO device 38 reaches the breakover voltage rating of such device. VBO device 38 then rapidly breaks over (i.e., becomes conductive), causing the voltage across capacitor 34 to be impressed directly across the winding turns 40. This induces a voltage across the remaining winding turns 44, which adds to the voltage across winding turns 40 and the voltage across ballast capacitor 27, to create an ignitor pulse 32 that is high relative to ballast voltage 21. With respect to the specific implementation set forth in FIG. 1, ignitor pulse 32 is typically 2,500 volts or higher with respect to reference node 25 as required by the lamp specification. FIG. 2 depicts a plurality of ignitor pulses 32 on the ballast voltage 21 operating on a 2.00 ms time scale. Also, the ignitor pulses are shown to be approximately 3,000 volts.

Other forms of ignitor pulse circuit 30 may include a conventional two-terminal ignitor circuit. U.S. Pat. No. 4,916,364 to Collins discloses an example of a conventional two-terminal ignitor circuit. Such an ignitor circuit incorporates its own transformer for creating a pulse of current, rather than tapping into secondary winding 18 at 42, as shown.

For starting HID lamp 14, a pulse autotransformer 60 is used to amplify the ignitor pulse 32. The pulse autotransformer 60 includes a tap, a start-to-tap winding 61 coupled to a capacitor 50, and a tap-to-finish winding 62 coupled to lamp 14.

When capacitor 34 becomes charged sufficiently that VBO device 38 fires creating ignitor pulse 32, the rapid voltage change across start-to-tap (i.e., primary) winding 61 caused by the ignitor pulse 32 results in an ignitor pulse 63 across tap-to-finish (i.e., secondary) winding 62, which is coupled to lamp 14. As with pulse 32, the leading edge 64 of pulse 63 comprises the higher frequency content of pulse 63 and is referred to herein as a high frequency and high voltage ignitor pulse 63, although such pulse may comprise only the higher frequency part of the overall pulse 32.

Figure 3:
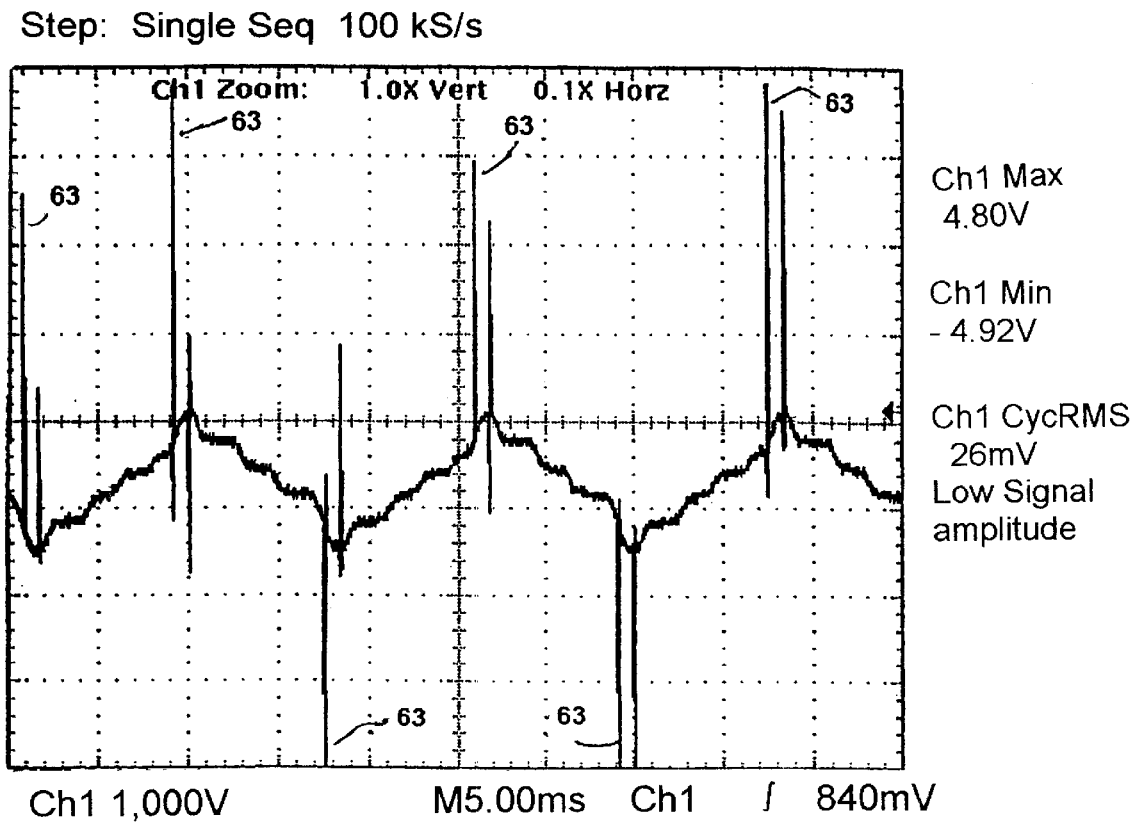
FIG. 3 shows the open circuit voltage of the ballast/ignitor circuit of FIG. 1 with respect to a subsequent serially connected HID lamp.

FIG. 3 depicts an example of the ignitor pulses 63 on the open circuit voltage of HID lamp 14. Multiple ignitor pulses 63 are shown, each approximately 4,000 volts above the fundamental component of the voltage.

Figure 4:
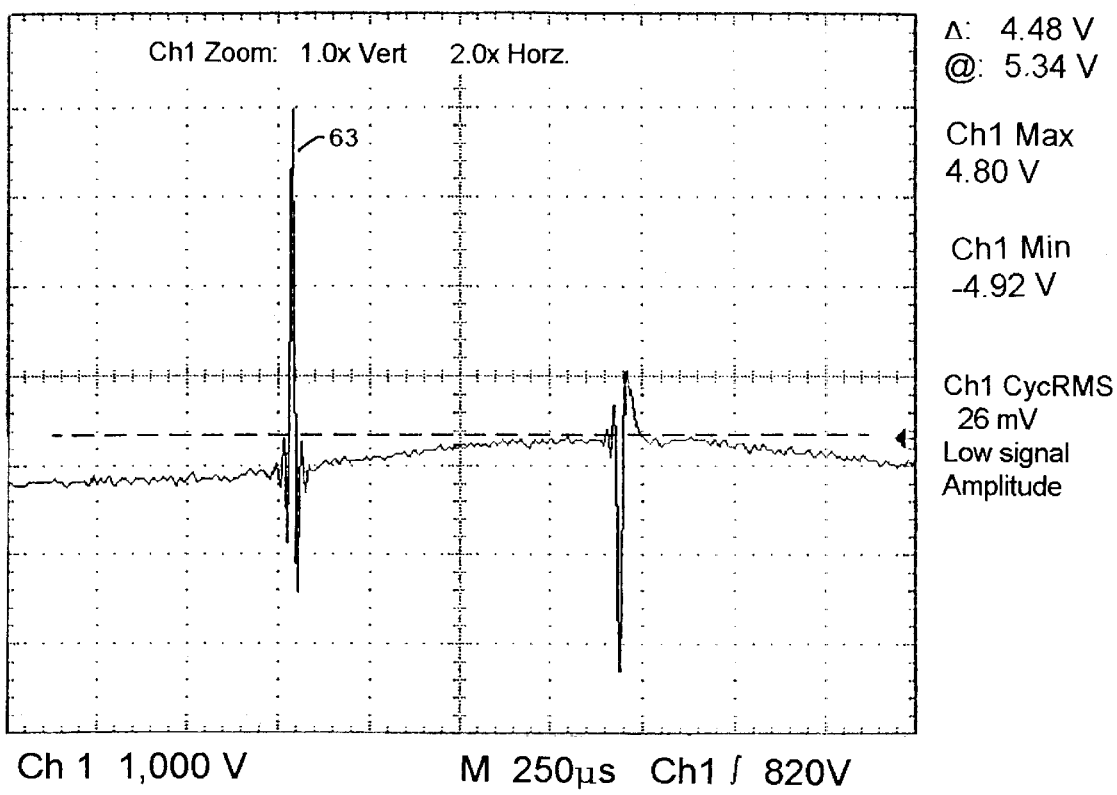
FIG. 4 shows a more detailed view of ignitor pulses from the open circuit voltage of FIG. 3.

FIG. 4 is a view of a ignitor pulse 63 on the open circuit voltage of HID lamp 14 at a scale of 250 $\mu$s as opposed to 5.00 ms scale shown in connection with FIG. 3. Again, this example of ignitor pulse 63 is approximately 4,000 volts above the fundamental component of the voltage.

As shown in FIG. 1, ballast transformer 16 preferably provides a ballast voltage 21 comprising a fundamental component 22 and a peak component 23. The peak component 23 is substantially higher in frequency and magnitude than the fundamental component 22. The frequency of peak component 23 is especially high on its upwardly rising slope from the fundamental component 22. Periodic negative-voltage excursions of ballast voltage 21 are typically symmetrical to its positive-voltage excursions.

In the process of starting lamps 12 and 14, lamp 12 will begin to start first. Typically, it will enter into a so-called glow mode, in which its impedance substantially drops in value. This allows the necessary current for creating an adequate ignitor pulse for starting the second lamp to be supplied through the first lamp 12.

In a specific implementation of the ballast/ignitor circuit of FIG. 1 the following component values may be used for a pair of 135-volt, 320-watt metal halide lamps, wherein polarities of transformer windings are indicated by dots in FIG. 1, and the regulating ballast is providing 3.2 amps lamp current: a) Ballast capacitor 27—20 microfarads, b) Source voltage 20—277 volts r.m.s., c) Number of winding turns 40—28 turns, d) Number of winding turns 44—391 turns, e) Starting capacitor 34—0.16 microfarads, f) Resistor 36—20.0 k ohms, g) Capacitor 50—0.22 microfarads, h) Number of turns of start-to-tap winding 61—3 turns, and i) Number of turns of tap-to-finish winding 62—45 turns.

The VBO device 38 may comprise one or more serially connected SIDACs having a total breakover voltage of 225 volts, such as available under Part No. KIV24 from Shidengen Electric Mfg. Co. Ltd. of Tokyo, Japan.

Figure 5:
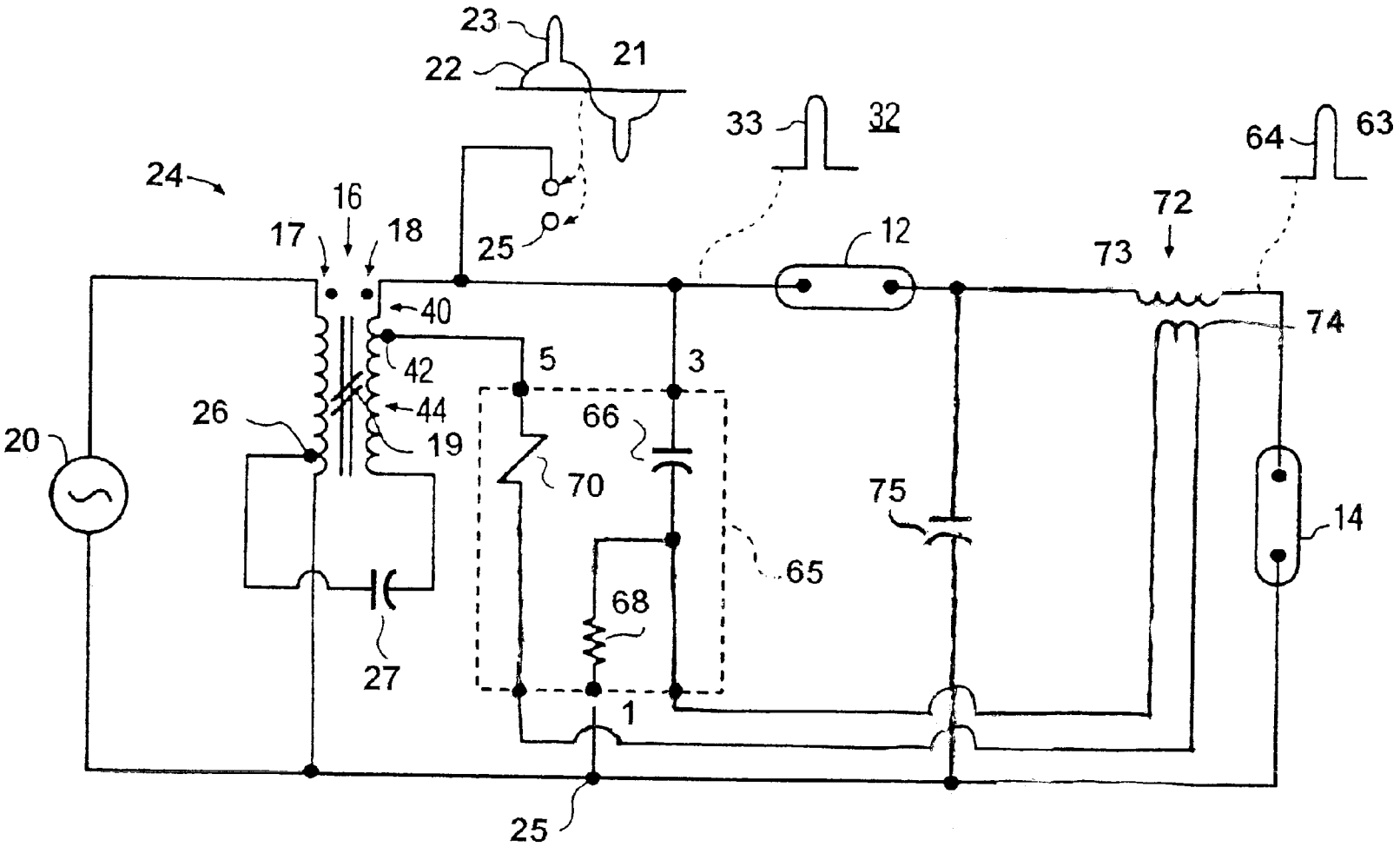
FIG. 5 is a schematic diagram of a ballast/ignitor circuit for powering a plurality HID lamps in accordance with another embodiment of the invention.

FIG. 5 shows a ballast/ignitor circuit 24 for powering two HID lamps 12, 14. As shown, the HID lamps 12, 14 are connected in series. The ballast/ignitor circuit 24 is a CWA circuit. A primary winding 17 of an electromagnetic (e-m) component 16 receives an AC power signal from a source 20, and produces, as an output, a ballast voltage 21 on secondary winding 18 with respect to a reference node 25, for driving the HID lamps 12, 14. The e-m component 16 is part of a regulating ballast; its secondary winding 18 is tapped into primary winding 17 at 26, and its primary and secondary windings 17, 18 are shunted as indicated by diagonal lines 19. A ballast capacitor 27 produces a desired phase angle between current and voltage supplied by source 20, and, in combination with e-m component 16, limits current to the HID lamps 12, 14.

The specific type of e-m component used, however, is not critical to the invention, and other e-m components providing a suitable ballast voltage for driving the HID lamps 12, 14 may be used, such as a reactor or lag ballast.

For starting the HID lamps 12, 14, ballast/ignitor circuit 24 includes an ignitor pulse circuit 65 and a pulse transformer 72 for producing an ignitor pulse 32 for HID lamp 12 and an ignitor pulse 63 for HID lamp 14. Of particular interest is the high frequency content of the rapidly rising, leading edge 33 of ignitor pulse 32 with respect to ballast voltage 21. Such high frequency content is referred to herein as a high frequency and high voltage ignitor pulse 32, although such pulse may comprise only the higher frequency part of the overall ignitor pulse 32.

Figure 6:
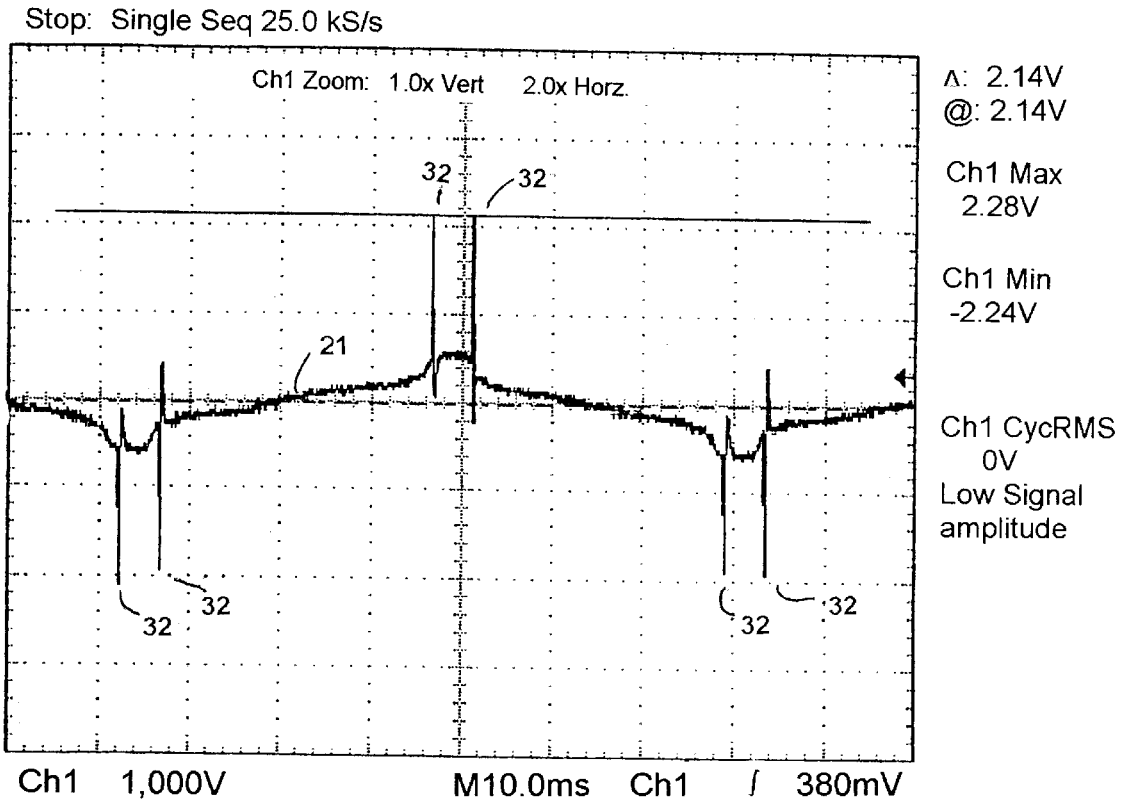
FIG. 6 shows the open circuit voltage of the ballast/ignitor circuit of FIG. 5 with respect to a first serially connected HID lamp.

Although the ignitor pulse 32 is shown as positive, on the next negative excursion of ballast voltage 21, the ignitor pulse 32 would be negative, as shown in FIG. 6. The particular form of ignitor pulse circuit 65 shown is merely exemplary and other configurations will be apparent to those of ordinary skill in the art based on this specification.

Ignitor pulse circuit 65 includes a capacitor 66, which becomes charged from ballast voltage 21 via a resistor 68. The voltage across capacitor 66 is impressed across the series combination of a primary winding 74 of the pulse transformer 72, a VBO device 70, and a number of winding turns 40. During HID lamp 12, 14 starting, the voltage on capacitor 66 continues to rise until the similarly increasing voltage across VBO device 70 reaches the breakover voltage rating of such device. The VBO device 70 then rapidly breaks over (i.e., becomes conductive), causing the voltage across capacitor 66 to be divided between the winding turns 40 of the e-m component 16 and the primary winding 74 of the pulse transformer 72. This induces a voltage across the remaining winding turns 44 of the e-m component 16, which adds to the voltage across winding turns 40 and the voltage across ballast capacitor 27, to create an ignitor pulse 32 that is high relative to ballast voltage 21. With respect to the specific implementation set forth in FIG. 5, ignitor pulse 32 is typically 2,500 volts or higher with respect to reference node 25 as required by the lamp specification. FIG. 6 depicts a plurality of ignitor pulses 32 on the ballast voltage 27 operating on a 10.0 ms time scale. Also, the ignitor pulses are shown to be approximately 2,140 volts.

Other forms of ignitor pulse circuit 65 may include a conventional two-terminal ignitor circuit. U.S. Pat. No. 4,916,364 to Collins discloses an example of a conventional two-terminal ignitor circuit. Such an ignitor circuit incorporates its own transformer for creating a pulse of current, rather than tapping into secondary winding 18 at 42, as shown.

Returning to starting lamp 14, the voltage across the primary winding 74 induces a corresponding voltage across the secondary winding 73 of the pulse transformer 72. The induced voltage creates ignitor pulse 63 that is high relative to ballast voltage 21. With respect to the specific implementation set forth in FIG. 5, ignitor pulse 63 is typically 2,500 volts or higher with respect to reference node 25 as required by the lamp specification. The secondary winding 73 is coupled to lamp 14. As with pulse 32, the leading edge 64 of pulse 63 comprises the higher frequency part of pulse 63 and is referred to herein as an ignitor pulse 63. To assist coupling of ignitor pulse 63 to the HID lamp 14, a capacitance 75 is employed. At the high frequency of the ignitor pulse 63, the capacitance 75 appears as a low impedance across which a low voltage drop occurs. Capacitance 75 thus impresses most of the ignitor pulse 63 to appear across the lamp, to facilitate its starting. Capacitance 75 may comprise parasitic capacitance of the conductors supplying lamps 12 and 14, or it may comprise a discrete capacitor.

Figure 7:
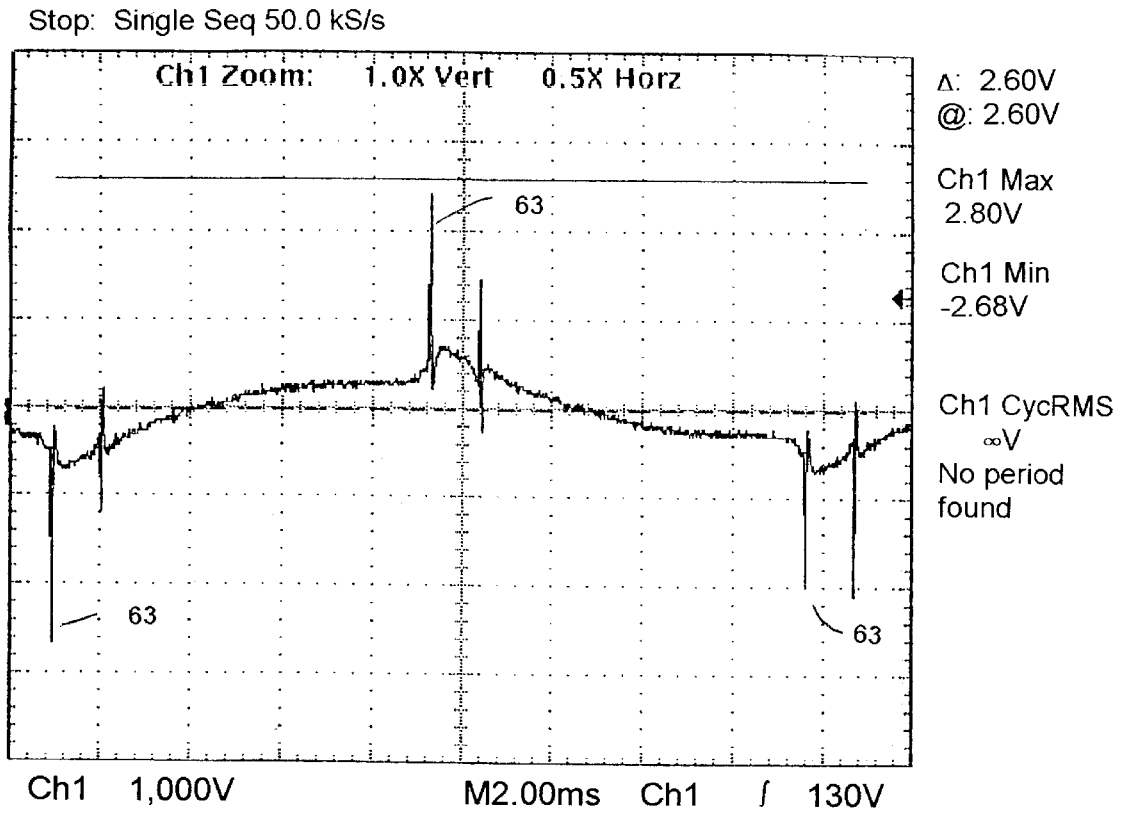
FIG. 7 shows the open circuit voltage of the ballast/ignitor circuit of FIG. 5 with respect to a subsequent serially connected HID lamp.

FIG. 7 depicts an example of the ignitor pulses 63 on the open circuit voltage of HID lamp 14. Multiple ignitor pulses 63 are shown, each approximately 2,500 volts above the fundamental component of the voltage.

Figure 8:
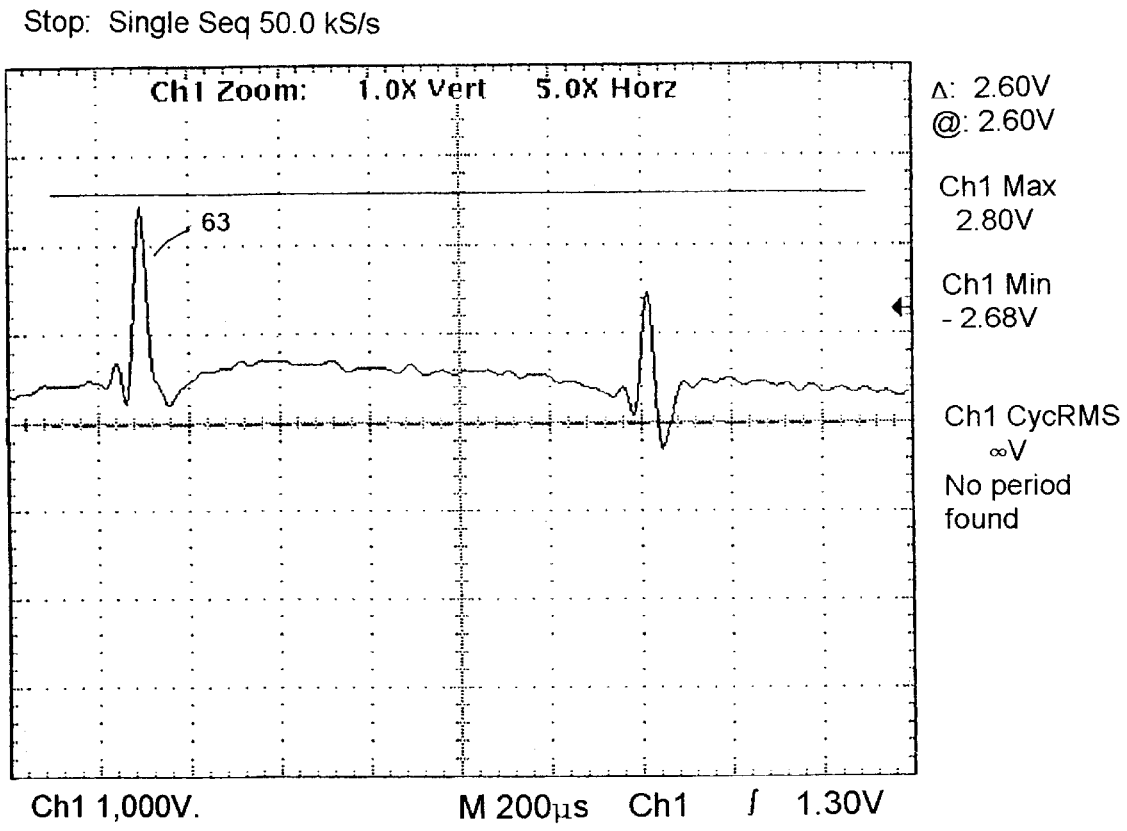
FIG. 8 shows a more detailed view of ignitor pulses from the open circuit voltage of FIG. 7.

FIG. 8 is a view of ignitor pulse 63 on the open circuit voltage of HID lamp 14 at a scale of 200 $\mu$s as opposed to the 2.00 ms scale shown in connection with FIG. 7. Again this example of an ignitor pulse 63 is approximately 2,500 volts above the fundamental component of the voltage.

As shown in FIG. 5, ballast transformer 16 preferably provides a ballast voltage 21 having a component 22 comprising a fundamental component, and a peak component substantially higher in frequency and magnitude than the fundamental component. The frequency of peak component 23 is especially high on its upwardly rising slope from the fundamental component. Periodic negative-voltage excursions of ballast voltage 21 are typically symmetrical to its positive-voltage excursions.

When starting the HID lamps 12, 14 using the ballast/ignitor circuit 24 of FIG. 5, both lamps 12, 14 begin to start simultaneously. The ballast/ignitor circuit 24 generates two ignitor pulses 32, 63 simultaneously by discharging capacitor 66 through winding turns 40 of the e-m component 16 and the primary winding 74 of the pulse transformer 72.

In a specific example of implementing the ballast/ignitor circuit of FIG. 5, the following component values may be used for a pair of 135-volt, 320-watt metal halide lamps, wherein polarities of transformer windings are indicated by dots in FIG. 5, and the regulating ballast is providing 3.2 amps lamp current: a) Ballast capacitor 27—20 microfarads, b) Source voltage 20—277 volts RMS, c) Number of winding turns 40—28 turns, d) Number of winding turns 44—391 turns, e) Starting capacitor 66—0.1.6 microfarads, f) Resistor 68—20.0 k ohms, g) Capacitance 75—200 picofarads, h) Number of turns of secondary winding 73–45 turns, and i) Number of turns of primary winding 74—3 turns.

The VBO device 70 may comprise one or more serially connected SIDACs having a total breakover voltage of 225 volts, such as available under Part No. KIV24 from Shidengen Electric Mfg. Co. Ltd. of Tokyo, Japan.

HID lamps other than metal halide lamps as described in both embodiments (FIGS. 1 and 5) above can be used. In order to most reliably benefit from the present invention, however, an HID lamp should have a reasonably constant operating voltage over its lifetime. Because the same current flows through all serially connected lamps, the respective wattages of the lamps are strongly dependent on their respective operating voltages. Essentially, such operating voltages should not vary so greatly over the lifetime of the lamps that the respective wattages of the lamps vary into undesired (e.g. outside-of-rated) ranges. It is most preferred that such lamp operating voltage be maintained to within about 15–20 percent of a nominal value, although, depending on ballast capacity, more variation can be tolerated. For high pressure sodium lamps, the lamp voltage is dependent on the lamp current and it is possible to get into a situation where one of the serially connected lamps has a higher voltage and a corresponding higher wattage than the second lamp. The higher power will commonly result in a faster rate of voltage rise with time and this can result in a runaway condition where the higher voltage lamp ends up with a very high voltage and operating wattage. The other lamp can end up with a proportionately low voltage and low wattage. Under these conditions, the high voltage lamp will very likely have a shortened life and a low efficacy. The solution is to operate lamps in series that have "constant" voltage characteristics. In other words, the lamp voltage is relatively independent of the lamp current. Metal halide and mercury lamps fit this description. In addition, a class of high pressure sodium lamps (i.e., limited dose lamps) are less sensitive to voltage variation with current and life. This class of high pressure sodium lamps would also be very suitable for use with a series operation, as in the present invention.

Within the foregoing, general constraint of lamp-operating voltage being reasonably constant, a series of lamps powered in accordance with the invention can be of mixed variety, e.g. a metal halide lamp connected to a mercury lamp. By way of example, limited-dose sodium lamps also typically have a reasonably constant operating voltage.

The principles of the present invention extend to the sequential starting of more than two lamps as described above. This is accomplished for the ballast/ignitor circuit of FIG. 1 by repeating the pulse autotransformer 60 and coupling capacitor 50 for each additional lamp. Similarly, the ballast/ignitor circuit of FIG. 5 can extend to sequential starting of more than two lamps by repeating the pulse transformer 72 and capacitance 75 for each additional lamp. In such cases, a third lamp would start after the second lamp enters a glow mode and drops substantially in impedance to allow sufficient current to start the third lamp.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. A ballast circuit for serially connected high intensity discharge lamps comprising:

an electromagnetic ballast arrangement receptive of an input power signal, providing an output ballast voltage for driving the lamps, and providing an open circuit ballast voltage when the lamps are disconnected from the arrangement; and an ignitor circuit connected to the ballast arrangement and to each lamp for starting all of the lamps and for producing at least one ignitor pulse of high voltage and high frequency compared to the open circuit ballast voltage to start each lamp, the ignitor circuit comprising:

a voltage-breakover device;

a first capacitor with a first lead coupled to a first lead of the voltage-breakover device;

a resistor with a first lead coupled to the first lead of the voltage-breakover device and the first lead of the first capacitor;

a pulse autotransformer associated with each subsequent serially connected high intensity discharge lamp after a first lamp of the plurality of serially connected lamps, the autotransformer having a winding connected between two serially connected lamps and a tap; and a second capacitor with first and second leads, wherein the first lead is coupled to a second lead of the resistor and the second lead is coupled to the tap of the pulse autotransformer.

2. The ballast circuit of claim 1, wherein each of the serially connected high intensity discharge lamps comprises one of a group of metal halide lamps, ceramic metal halide lamps, high pressure sodium lamps, and mercury lamps.

3. A ballast circuit for serially connected high intensity discharge lamps comprising:

an electromagnetic ballast arrangement receptive of an input power signal, providing an output ballast voltage for driving the lamps, and providing an open circuit ballast voltage when the lamps are disconnected from the arrangement; and an ignitor circuit connected between the ballast arrangement and each lamp for starting all of the lamps and for producing at least one ignitor pulse of high voltage and high frequency compared to the open circuit ballast voltage to start each lamp, the ignitor circuit comprising:

a voltage-breakover device;

a first capacitor;

a resistor with a first lead coupled to a first lead of the first capacitor;

a pulse transformer associated with each subsequent serially connected high intensity discharge lamp after a first lamp of the serially connected lamps, the pulse transformer having a primary winding and a secondary winding, wherein the secondary winding is connected between two serially connected lamps and the primary winding is connected between the voltage-breakover device and the coupled first capacitor and resistor; and a second capacitor with a first lead coupled to a second lead of the resistor and a second lead coupled to a first lead of the secondary winding, said first lead of the secondary winding also being coupled to a preceding serially connected lamp.

4. The ballast circuit of claim 3, wherein the serially connected high intensity discharge lamps comprise one of metal halide lamps, ceramic metal halide lamps, high pressure sodium lamps, and mercury lamps.

5. An ignitor circuit for starting each of serially connected high intensity discharge lamps comprising:

a voltage-breakover device;

a first capacitor with a first lead coupled to a first lead of the voltage-breakover device;

a resistor with a first lead coupled to the first lead of the voltage-breakover device and the first lead of the first capacitor;

a pulse autotransformer associated with each subsequent serially connected high intensity discharge lamp after a first lamp of serially connected lamps, the autotransformer having a winding connected between two serially connected lamps and a tap; and a second capacitor with first and second leads, wherein the first lead is coupled to a second lead of the resistor and the second lead is coupled to the tap of the pulse autotransformer.

6. The ignitor circuit of claim 5, wherein each of the serially connected high intensity discharge lamps comprise one of metal halide lamps, ceramic metal halide lamps, high pressure sodium lamps, and mercury lamps.

7. An ignitor circuit for starting serially connected high intensity discharge lamps comprising:

a voltage-breakover device;

a first capacitor;

a resistor with a first lead coupled to a first lead of the first capacitor;

a pulse transformer associated with each subsequent serially connected high intensity discharge lamp after a first lamp of the plurality of serially connected lamps, the pulse transformer having a primary winding and a secondary winding, wherein the secondary winding is connected between two serially connected lamps and the primary winding is connected between the voltage-breakover device and the coupled first capacitor and resistor; and a second capacitor with a first lead coupled to a second lead of the resistor and a second lead coupled to a first lead of the secondary winding, said first lead of the secondary winding also being coupled to a preceding serially connected lamp.

8. The ignitor circuit of claim 7, wherein the serially connected high intensity discharge lamps comprise one of metal halide lamps, ceramic metal halide lamps, high pressure sodium lamps, and mercury lamps.

* * * * *